US011738227B2

(12) United States Patent
An

(10) Patent No.: US 11,738,227 B2
(45) Date of Patent: Aug. 29, 2023

(54) FOREARM FITNESS EQUIPMENT

(71) Applicant: GD IND Corp., Incheon (KR)

(72) Inventor: Tae Jin An, Incheon (KR)

(73) Assignee: GD IND Corp., Incheon (KR)

( * ) Notice: Subject to any disclaimer, the term of this patent is extended or adjusted under 35 U.S.C. 154(b) by 89 days.

(21) Appl. No.: 17/644,391

(22) Filed: Dec. 15, 2021

(65) Prior Publication Data

US 2022/0184444 A1 Jun. 16, 2022

(30) Foreign Application Priority Data

Dec. 16, 2020 (KR) ..... 10-2020-0176654

(51) Int. Cl.
*A63B 23/14* (2006.01)
*A63B 21/00* (2006.01)
(Continued)

(52) U.S. Cl.
CPC .. *A63B 21/00065* (2013.01); *A63B 21/00069* (2013.01); *A63B 21/015* (2013.01);
(Continued)

(58) Field of Classification Search
CPC ..... A63B 21/0004; A63B 21/00065; A63B 21/00069; A63B 21/015; A63B 21/023;
(Continued)

(56) References Cited

U.S. PATENT DOCUMENTS 2,973,962 A * 3/1961 Griffin ..... A63B 23/14 73/379.08
3,396,967 A * 8/1968 Brown ..... A63B 23/14 482/46
(Continued)

FOREIGN PATENT DOCUMENTS

CN 1291110 A 4/2001
JP 2007050228 A 3/2007
(Continued)

OTHER PUBLICATIONS

Office Action issued in Chinese Application No. 202111524161.7, dated Feb. 15, 2023 (7 pages).
(Continued)

*Primary Examiner* — Joshua Lee
(74) *Attorney, Agent, or Firm* — Osha Bergman Watanabe & Burton LLP

(57) ABSTRACT

The present invention relates to forearm fitness equipment having a first handlebar and a second handlebar which are arranged in a longitudinal direction. The first handlebar includes a twist guide part and a first spiral inclined surface formed on an end surface of one side of the twist guide part. The second handle bar includes a second spiral inclined surface on an end surface, which comes into contact with the first spiral inclined surface. The first and second spiral inclined surfaces extend spirally respective in an opposite rotational direction to each other. A spring is configured to provide an elastic force in a direction in which the first spiral inclined surface and the second spiral inclined surface come into contact with each other.

14 Claims, 7 Drawing Sheets

(51) Int. Cl.
*A63B 21/015* (2006.01)
*A63B 23/035* (2006.01)
*A63B 23/00* (2006.01)

(52) U.S. Cl.
CPC ..... *A63B 21/4035* (2015.10); *A63B 21/4049* (2015.10); *A63B 23/03533* (2013.01); *A63B 23/14* (2013.01); *A63B 2023/003* (2013.01)

(58) Field of Classification Search
CPC ..... A63B 21/045; A63B 21/0455; A63B 21/4035; A63B 21/4049; A63B 23/03533; A63B 23/12; A63B 23/14; A63B 2023/003
See application file for complete search history.

(56) References Cited

U.S. PATENT DOCUMENTS 3,830,493 A * 8/1974 Miller ..... A63B 23/14 482/46
4,095,789 A * 6/1978 Mueller ..... A63B 23/14 482/46
4,643,417 A * 2/1987 Nieman ..... A63B 21/00069 482/46
4,651,985 A * 3/1987 Salisbury ..... A63B 21/00043 482/122
4,695,049 A * 9/1987 Ciemiega ..... A63B 23/14 482/46
4,913,417 A * 4/1990 Francu ..... A63B 21/05 482/45
5,690,598 A * 11/1997 Liang ..... A63B 23/14 482/121
5,776,034 A * 7/1998 Stamler ..... A63B 23/14 482/45
5,941,799 A * 8/1999 Bergdorf ..... A63B 21/0455 482/44
6,106,438 A * 8/2000 Dean ..... A63B 23/14 482/44
8,777,821 B2 * 7/2014 Lando ..... A63B 23/1245 482/121
9,387,360 B2 * 7/2016 Niederman ..... A63B 21/00069
10,569,131 B2 * 2/2020 Niederman ..... A63B 21/015
2003/0027697 A1 2/2003 Baumler
2016/0074689 A1 * 3/2016 Anderson ..... A63B 21/00069 482/127

FOREIGN PATENT DOCUMENTS

JP 2018166975 A 11/2018
KR 200298614 Y1 12/2002

OTHER PUBLICATIONS

Office Action issued in Korean Application No. 10-2020-0176654, dated Sep. 26, 2022 (9 pages).

* cited by examiner

[Fig. 1]
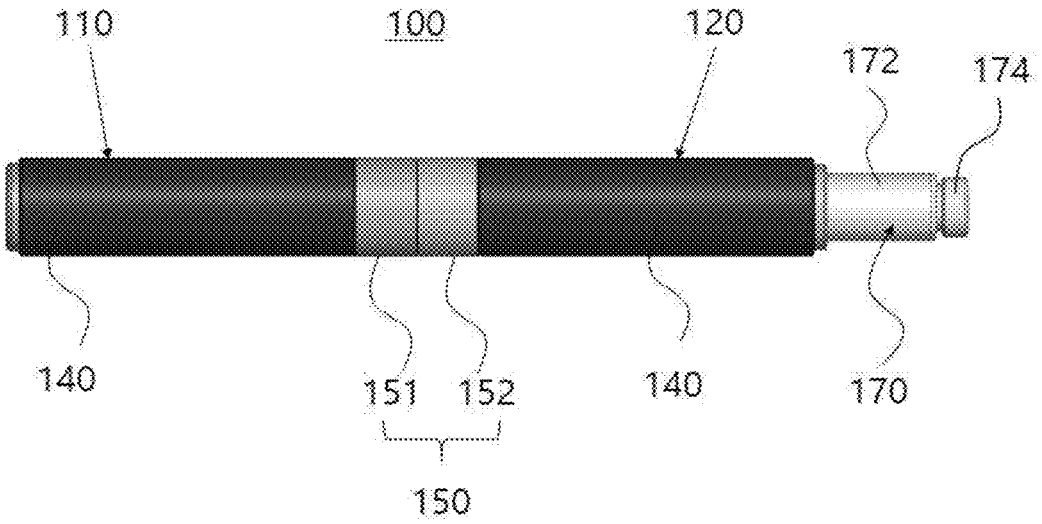

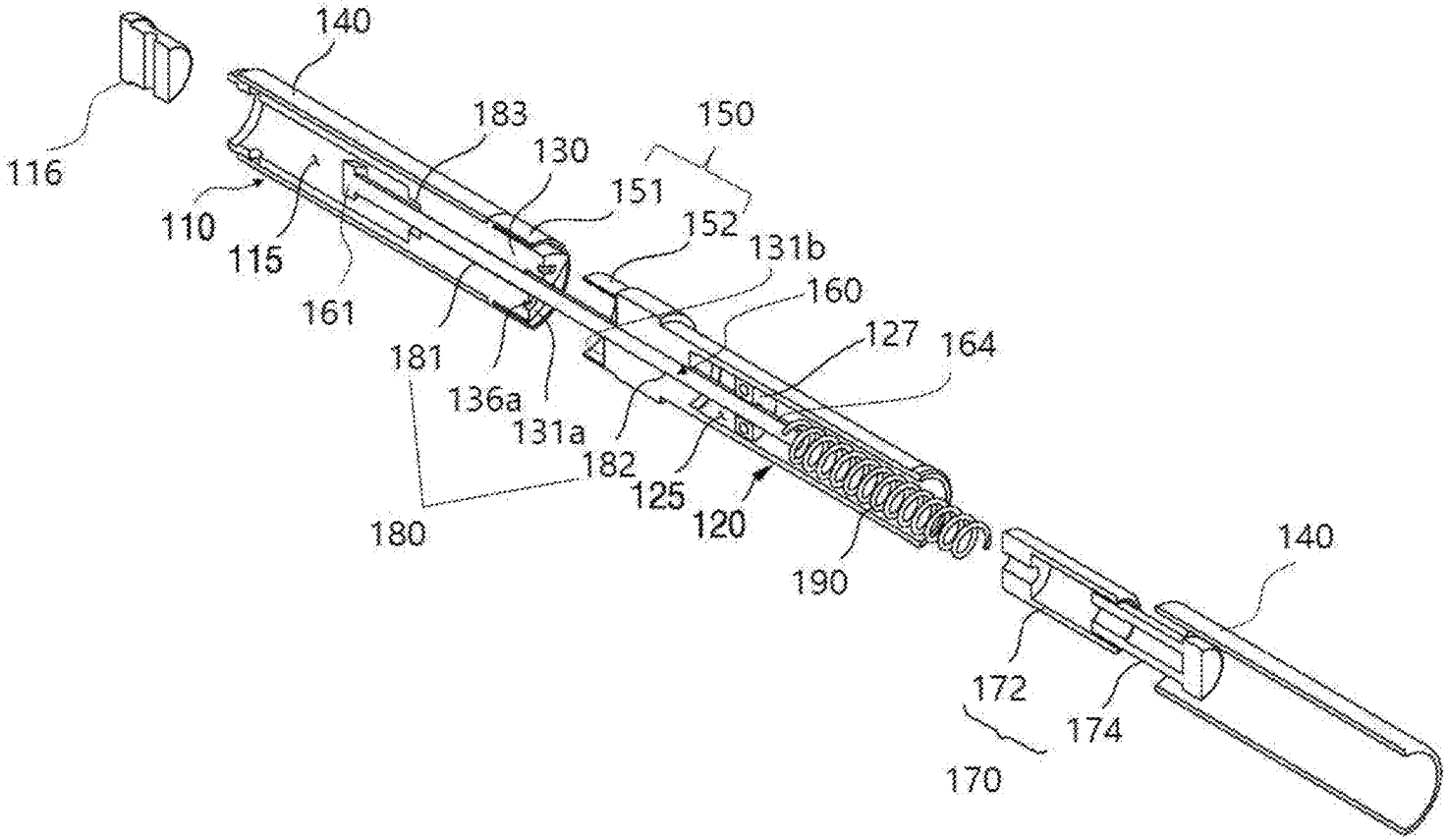
[Fig. 2]

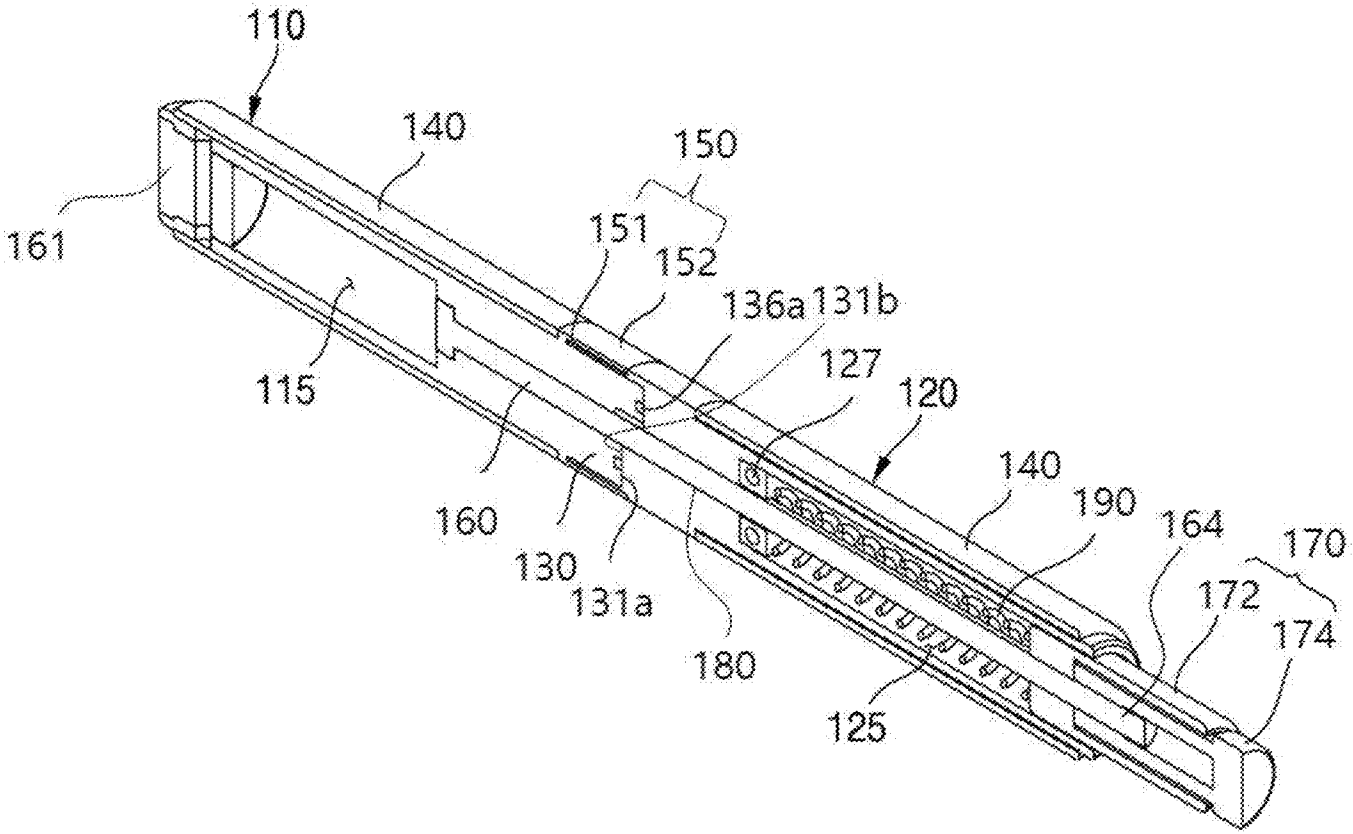
[Fig. 3]

[Fig. 4]
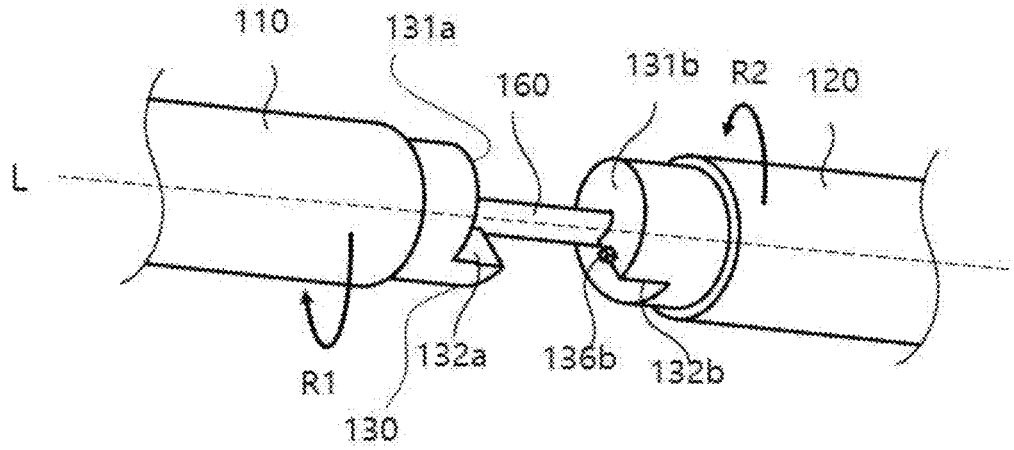
[Fig. 5]
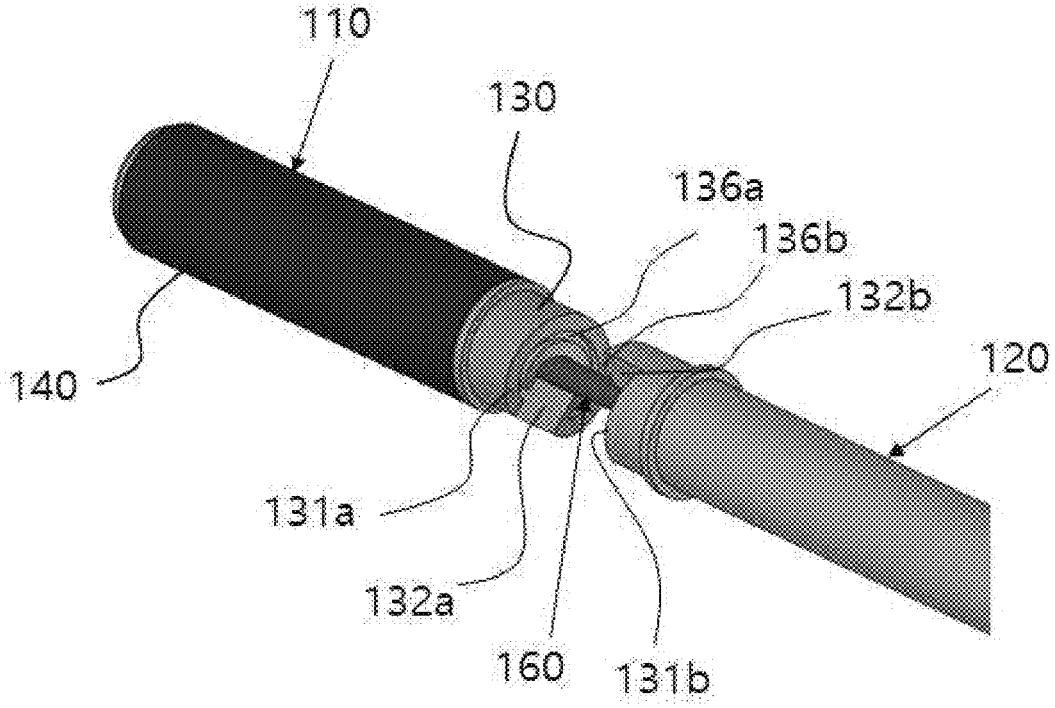

[Fig. 6]
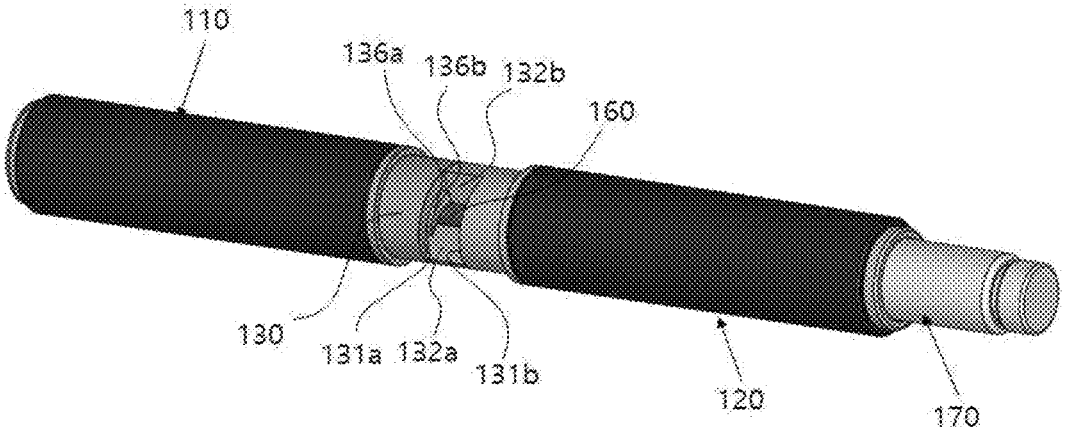

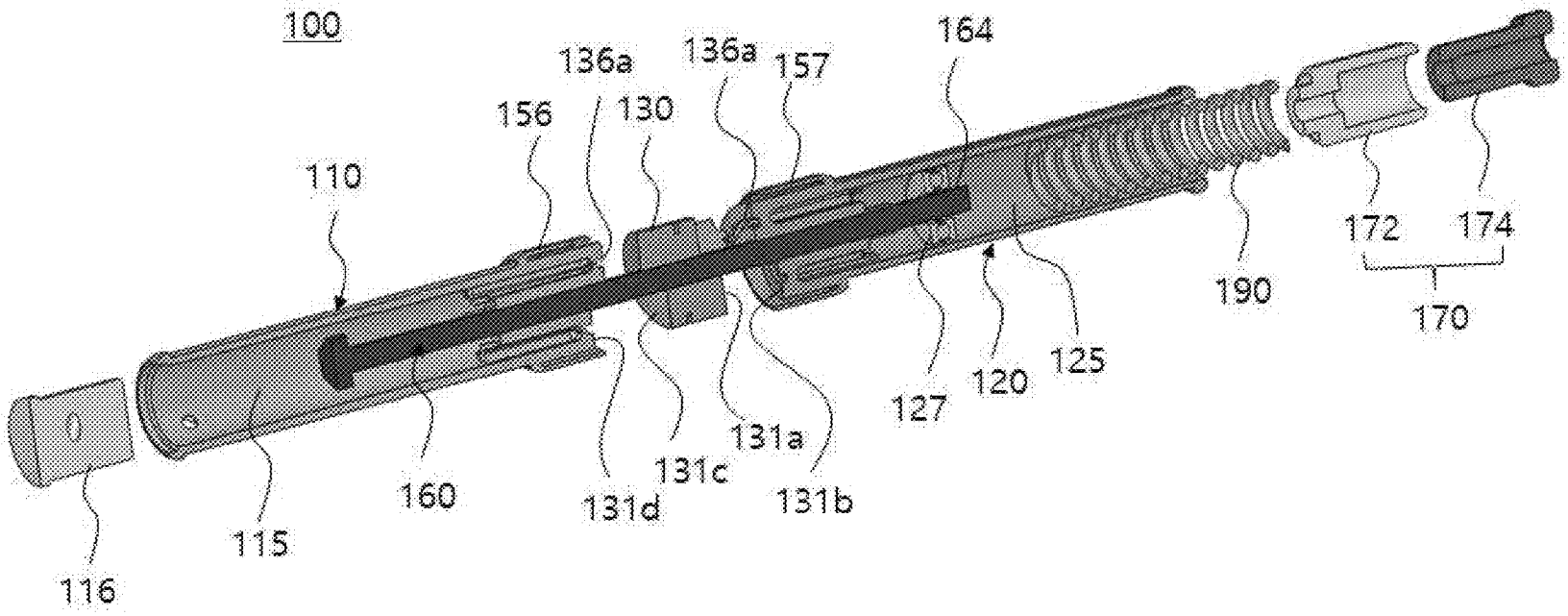
[Fig. 7]

[Fig. 8]
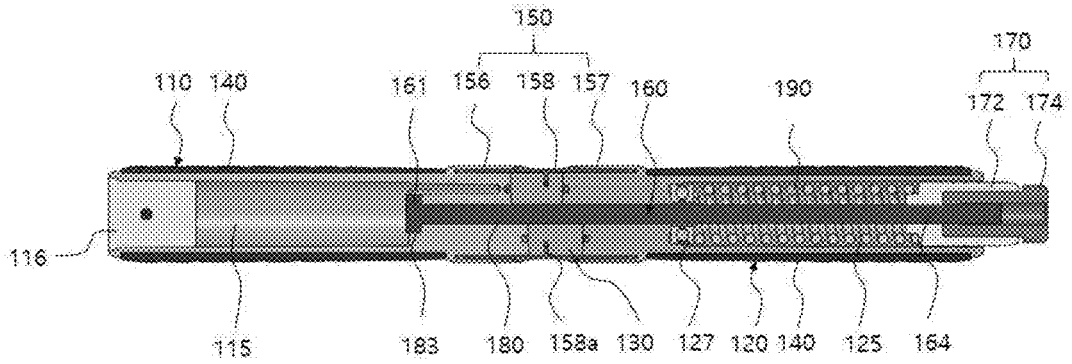
[Fig. 9]
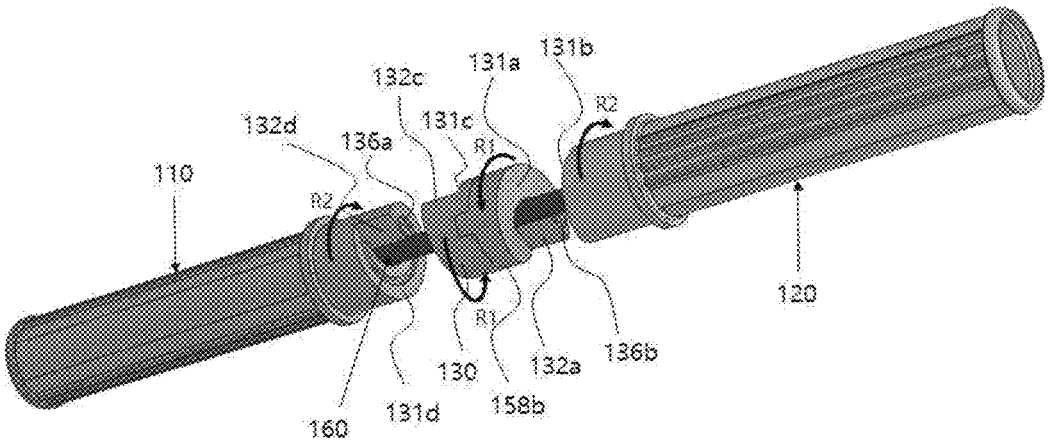
[Fig. 10]
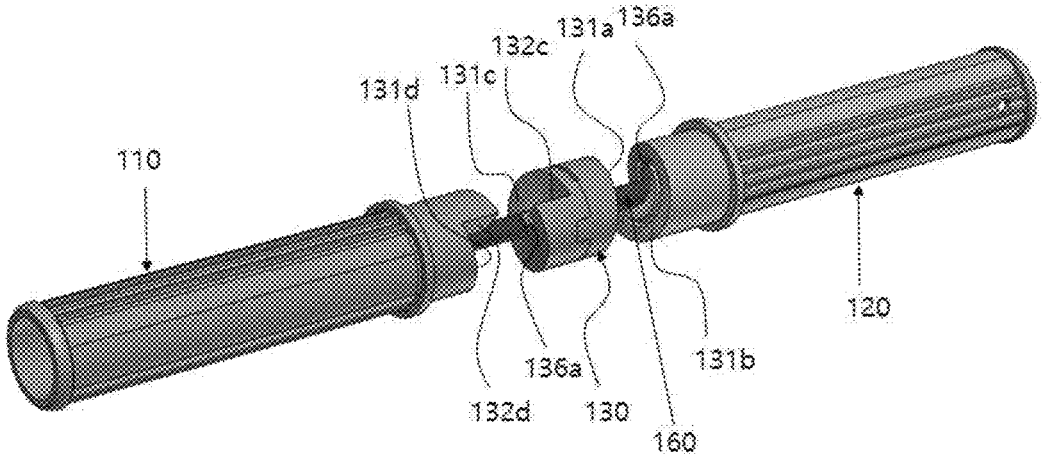

FOREARM FITNESS EQUIPMENT

This application claims priority to and the benefit of Korean Patent Application No. 2020-0176654, filed on Dec. 16, 2020, the disclosure of which is incorporated herein by reference in its entirety.

BACKGROUND

1. Field of the Invention

The present invention relates to forearm fitness equipment and, more specifically, to forearm fitness equipment capable of training a forearm by twisting a handlebar using both hands.

2. Discussion of Related Art

Generally, an exercise of training a forearm is performed to strengthen muscles of a wrist or forearm. For example, as a method of training the forearm, fitness equipment is used by performing a wrist rolling method of alternately winding upward and unwinding downward a string or strap on which a weight is hung at an end portion thereof and which is tied around a pipe which has a predetermined length.

The forearm fitness equipment of the wrist rolling method is effective to train the forearm, but when the string is wound upward, there is a problem in that the string is twisted or sways so as to cause discomfort of interfering with exercise, and since a weight, a rod, and a weight part are added, there are problems of inconvenience of portability and difficulty in adjustment of exercise intensity.

SUMMARY OF THE INVENTION

Therefore, the present invention is directed to providing forearm fitness equipment which has excellent portability and is capable of training muscles of a wrist and a forearm by twisting a handlebar gripped by both hands.

The present invention is directed to providing forearm fitness equipment which includes a first handlebar and a second handlebar, which are arranged in a longitudinal direction, and at least a pair of spiral inclined surfaces capable of guiding twisting movement of the first handlebar and the second handlebar to train a wrist and a forearm.

According to an aspect of the present invention, there is provided forearm fitness equipment having a first handlebar and a second handlebar arranged in a longitudinal direction, the first handlebar including a twist guide part formed on a side surface, which faces the second handlebar, of the first handlebar, the forearm fitness equipment including a first spiral inclined surface formed on an end surface of one side of the twist guide part and formed as an inclined surface spirally extending from an uppermost end to a lowermost end in a first rotational direction about a central axis in the longitudinal direction, a second spiral inclined surface formed on an end surface, which faces the twist guide part, of the second handlebar, formed as an inclined surface spirally extending from an uppermost end to a lowermost end in a second rotational direction opposite to the first rotational direction about the central axis in the longitudinal direction, and formed to be in contact with the first spiral inclined surface, and a spring installed to provide an elastic force in a direction in which the first spiral inclined surface and the second spiral inclined surface come into contact with each other.

The twist guide part may include a third spiral inclined surface formed to be separated from the first handlebar, formed on an end surface of the other side of the twist guide part, and formed as an inclined surface spirally extending from an uppermost end to a lowermost end in the first rotational direction about the central axis in the longitudinal direction, and a fourth spiral inclined surface formed on an end surface, which faces the twist guide part, of the first handlebar, formed as an inclined surface spirally extending from an uppermost end to a lowermost end in the second rotational direction about the central axis in the longitudinal direction, and formed to be in contact with the third spiral inclined surface.

The spiral inclined surfaces may include steps formed between the uppermost ends and the lowermost ends in spiral directions, and the spiral inclined surfaces in contact with each other may be relatively rotated in opposite directions at an exercise start position which is a position at which the steps are in contact with each other. Accordingly, in a pair of spiral inclined surfaces including the first spiral inclined surface and the second spiral inclined surface, a position, at which the step of the first spiral inclined surface and the step of the second spiral inclined surface are in contact with each other, may be the exercise start position, and in another pair of spiral inclined surfaces including the third spiral inclined surface and the fourth spiral inclined surface, a position, at which the step of the third spiral inclined surface and the step of the fourth spiral inclined surface are in contact with each other, may be the exercise start position.

A guide groove may be formed in one spiral inclined surface of the spiral inclined surfaces in contact with each other along a rotational path, a guide protrusion, which is movably inserted into the guide groove, may be formed on the remaining one spiral inclined surface of the spiral inclined surfaces in contact with each other, and when separation rotation is performed, the guide protrusion may be hooked on an end portion of the guide groove to restrict the separation rotation between the spiral inclined surfaces in contact with each other. Accordingly, in the pair of spiral inclined surfaces including the first spiral inclined surface and the second spiral inclined surface, and in the other pair of spiral inclined surfaces including the third spiral inclined surface and the fourth spiral inclined surface, when the separation rotation is performed, the spiral inclined surfaces may be prevented from being rotated beyond a range in which the spiral inclined surfaces are in contact with each other.

The forearm fitness equipment may include a connecting rod inserted through a rod insertion hole formed along the central axis in the longitudinal direction of the forearm fitness equipment and extending to the second handlebar in a state in which one end of the connecting rod is fixed to the first handlebar and a fixing lever fixed to the other end of the connecting rod, wherein one end of the spring may be fixed to the second handlebar, and the other end of the spring may be fixedly installed on the fixing lever.

A hollow may be formed in the second handlebar, the spring may be disposed in the hollow, and a bearing may be installed on an inner end portion, which is in contact with the one end of the spring, of the hollow.

The fixing lever may be formed so that a position of the fixing lever is adjustable along the other end of the connecting rod, and a twisting strength provided when an exercise is performed may be adjustable by changing a degree of compression of the spring to adjust a position of the fixing lever.

The fixing lever may be coupled to a coupling part formed on the connecting rod in a screw-coupling manner, and the fixing lever may include a first fixing lever screw-coupled to the connecting rod and including an accommodation space having a sleeve shape and a second fixing lever inserted into the accommodation space of the first fixing lever and screw-coupled to the connecting rod.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

FIG. 1 is a front view illustrating forearm fitness equipment according to one embodiment of the present invention;

FIG. 2 is an exploded cross-sectional view illustrating the forearm fitness equipment according to one embodiment of the present invention;

FIG. 3 is a cross-sectional view illustrating the assembled forearm fitness equipment according to one embodiment of the present invention;

FIGS. 4 and 5 are views for describing a spiral inclined surface of the forearm fitness equipment according to one embodiment of the present invention;

FIG. 6 is a view for describing an operation of the forearm fitness equipment according to one embodiment of the present invention;

FIG. 7 is an exploded cross-sectional view illustrating forearm fitness equipment according to a modified embodiment of the present invention;

FIG. 8 is a cross-sectional view for describing the assembly of the forearm fitness equipment according to the modified embodiment of the present invention; and FIGS. 9 and 10 are views for describing a twist guide part and a spiral inclined surface of the forearm fitness equipment according to the modified embodiment of the present invention.

DETAILED DESCRIPTION OF EXEMPLARY EMBODIMENTS

While the present invention may be modified in various ways and have various alternative forms, specific embodiments thereof will be described in detail below. However, there is no intent to limit the present invention to particular forms disclosed, and it should be understood that the present invention covers all modifications, equivalents, and alternatives falling within the range of the spirit and scope of the present invention. When appended drawings are described, like numbers refer to like elements.

These terms are used only for distinguishing one element from another element. The terminology used herein is for the purpose of describing particular embodiments only and is not intended to limit the present invention. The singular forms are intended to include the plural forms, unless the context clearly indicates otherwise.

Hereinafter, embodiments of the present invention will be described in detail with reference to the accompanying drawings.

FIG. 1 is a front view illustrating forearm fitness equipment according to one embodiment of the present invention, FIG. 2 is an exploded cross-sectional view illustrating the forearm fitness equipment according to one embodiment of the present invention, FIG. 3 is a cross-sectional view illustrating the assembled forearm fitness equipment according to one embodiment of the present invention, and FIGS. 4 and 5 are views for describing a spiral inclined surface of the forearm fitness equipment according to one embodiment of the present invention.

Forearm fitness equipment 100 according to one embodiment of the present invention includes a first handlebar 110 and a second handlebar 120.

The first and second handlebars 110 and 120 are formed in a bar shape and arranged in a longitudinal direction. According to the present invention, the first and second handlebars 110 and 120 may include hollows 115 and 125 therein, respectively.

In the present specification, the names of the first and second handlebars 110 and 120 are used only for distinguishing two handlebars gripped by both hands. In the present specification, for the sake of convenience of description, a handlebar positioned at a left side in FIG. 1 is referred to as the first handlebar 110, a handlebar positioned at a right side therein is referred to as the second handlebar 120, and the embodiment of the present invention will be described.

The first handlebar 110 and the second handlebar 120 may each include handle covers 140 which cover outer circumferential surfaces thereof. The handle cover 140 may have a surface on which protrusions are formed and may be formed of a material such as rubber or silicone. The handle cover 140 is provided to improve a grip feeling and prevent a slipping phenomenon when an exerciser grips the forearm fitness equipment 100.

Spiral inclined surfaces will be described in more detail with reference to FIGS. 4 and 5. FIG. 4 is a view illustrating a state in which first and second spiral inclined surfaces are spaced apart from each other at an exercise start position, and FIG. 5 is a view illustrating a state in which the first and second spiral inclined surfaces are relatively rotated and spaced apart from each other. When compared to FIG. 1, FIGS. 4 and 5 illustrate a state of forearm fitness equipment from which cover parts 150 are excluded.

According to the present invention, the first handlebar 110 includes a twist guide part 130 on a side surface facing the second handlebar 120. The twist guide part 130 may be integrally formed with the first handlebar 110. An end surface of the twist guide part 130 of the first handlebar 110 is arranged to face and be in contact with an end surface of the second handlebar 120.

Spiral inclined surfaces 131*a* and 131*b* extending in a spiral direction are formed as a pair to complementarily correspond to each other on the end surface of the twist guide part 130 of the first handlebar 110 and the end surface of the second handlebar 120. Since the first spiral inclined surface 131*a* and the second spiral inclined surface 131*b* are formed complementarily, the two spiral inclined surfaces may fit with each other in an arranged state to form a cylindrical shape and may be spaced apart from each other while rotated in opposite directions. That is, the first spiral inclined surface 131*a* and the second spiral inclined surface 131*b* extend in the spiral direction to guide rotation of the first spiral inclined surface 131*a* and the second spiral inclined surface 131*b* in the opposite directions about a central axis in the longitudinal direction.

Referring to FIGS. 4 and 5, the first spiral inclined surface 131*a* formed on one side of the twist guide part 130 of the first handlebar 110 spirally extends in a first rotational direction R1 about a central axis L in the longitudinal direction from an uppermost end toward a lowermost end in the spiral direction. The second spiral inclined surface 131*b* formed on one facing side of the second handlebar 120 spirally extends in a second rotational direction R2 about the central axis L in the longitudinal direction from an uppermost end toward a lowermost end in the spiral direction. The first rotational direction R1 and the second rotational direction R2 are opposite to each other. Accordingly, the first spiral inclined surface 131*a* and the second spiral inclined surface 131*b* may be moved away from each other while relatively rotating in the opposite directions.

According to the embodiment of the present invention, the second handlebar 120 is rotatable in one direction in a state in which the first handlebar 110 is gripped, the first handlebar 110 is rotatable in the other direction in a state in which the second handlebar 120 is gripped, and the first handlebar 110 and the second handlebar 120 are rotatable in the opposite directions. Hereinafter, an example of an operation, in which the second handlebar 120 is rotated in one direction in the state in which the first handlebar 110 is gripped, will be described.

The first handlebar 110 and the second handlebar 120 are relatively rotated in the opposite directions and are moved in directions away from each other by the first spiral inclined surface 131*a* and the second spiral inclined surface 131*b*. Accordingly, during a twisting exercise, a length of the forearm fitness equipment 100 increases.

Since the first spiral inclined surface 131*a* and the second spiral inclined surface 131*b* extend in the spiral direction, steps 132*a* and 132*b* are formed between the uppermost ends and the lowermost ends in the spiral direction. The first spiral inclined surface 131*a* and the second spiral inclined surface 131*b* may start rotation at a position, at which the steps 132*a* and 132*b* are in contact with each other, and relatively rotate in the opposite directions. Accordingly, the position at which the steps 132*a* and 132*b* are in contact with each other may be the exercise start position.

A separation prevention guide, which prevents the first spiral inclined surface 131*a* and the second spiral inclined surface 131*b* from being separated from each other when the first spiral inclined surface 131*a* and the second spiral inclined surface 131*b* are relatively rotated to be moved in the directions away from each other, may be formed. The separation prevention guide includes a guide groove 136*a* and a guide protrusion 136*b*.

The guide groove 136*a* is formed at any one of the first spiral inclined surface 131*a* and the second spiral inclined surface 131*b* along an extension path of the spiral inclined surface. The guide protrusion 136*b* is formed on the other of the first spiral inclined surface 131*a* and the second spiral inclined surface 131*b* to be movably inserted into the guide groove 136*a*. As illustrated in FIGS. 4 and 5, the guide groove 136*a* may be formed along the first spiral inclined surface 131*a*, and the guide protrusion 136*b* may be formed on the uppermost end of the second spiral inclined surface 131*b*. However, the guide protrusion 136*b* may be formed on the first spiral inclined surface 131*a*, and the guide groove 136*a* may be formed in the second spiral inclined surface 131*b*.

In a state in which the guide protrusion 136*b* is inserted into the guide groove 136*a*, the first spiral inclined surface 131*a* and the second spiral inclined surface 131*b* may be relatively rotated in the directions to be moved away from each other. The first spiral inclined surface 131*a* and the second spiral inclined surface 131*b* are allowed to be relatively rotated to a position at which the guide protrusion 136*b* is hooked on an end of the guide groove 136*a* by the guide groove 136*a* and the guide protrusion 136*b*. Accordingly, a range, in which the first spiral inclined surface 131*a* and the second spiral inclined surface 131*b* are rotated in the directions to be spaced apart from each other, is determined, and the first spiral inclined surface 131*a* and the second spiral inclined surface 131*b* are prevented from being rotated beyond a range in which the first spiral inclined surface 131*a* and the second spiral inclined surface 131*b* are in contact with each other. The position, at which the guide protrusion 136*b* is hooked on the end of the guide groove 136*a* when the first spiral inclined surface 131*a* and the second spiral inclined surface 131*b* are relatively rotated, is an exercise end position of one twisting exercise.

As described above, at the exercise start position at which the steps 132*a* and 132*b* meet, the user starts the twisting exercise of applying a force to relatively rotate the first handlebar 110 and the second handlebar 120 in the opposite directions, and the first handlebar 110 and the second handlebar 120 are rotated to the exercise end position at which the guide protrusion 136*b* meets the end of the guide groove 136*a*. Then, when the force applied to the second handlebar 120 is released, the first and second handlebars 110 and 120 are relatively rotated in directions to approach each other by an elastic restoring force of a spring 190 and are returned to the exercise start position at which the steps 132*a* and 132*b* of the first and second spiral inclined surfaces 131*a* and 131*b* meet.

While the first spiral inclined surface 131*a* and the second spiral inclined surface 131*b* are rotated from the exercise start position to the exercise end position, the first handlebar 110 and the second handlebar 120 are moved away from each other, and at this position in this case, a distance therebetween is a maximum moving distance.

The first handlebar 110 and the second handlebar 120 include the cover parts 150 which cover outer circumferential surfaces of the first spiral inclined surface 131*a* and the second spiral inclined surface 131*b*. The cover parts 150 may include a one cover part 151 extending from the first handlebar 110 and the other cover part 152 extending from the second handlebar 120 to cover the outer circumferential surfaces of the first spiral inclined surface 131*a* and the second spiral inclined surface 131*b* so as to overlap each other in a radial direction.

The one cover part 151 of the cover parts 150 extends in a cylindrical shape at a position spaced apart from the outer circumferential surface of the first spiral inclined surface 131*a*, and the other cover part 152 extends in a cylindrical shape to be in contact with the outer circumferential surface of the second spiral inclined surface 131*b*. When the first spiral inclined surface 131*a* and the second spiral inclined surface 131*b* are rotated relatively, the other cover part 152 is inserted into or moved outward from an inner side of the one cover part 151, that is, a space between the one cover part 151 and the outer circumference of the first spiral inclined surface 131*a*, and covers the first spiral inclined surface 131*a* and the second spiral inclined surface 131*b*. Accordingly, the cover parts 150 do not hinder the approaching, separation, and relative rotation between the first handlebar 110 and the second handlebar 120.

The cover parts 150 prevent the first spiral inclined surface 131*a* and the second spiral inclined surface 131*b* from being exposed to the outside to improve an exterior of the forearm fitness equipment and prevent foreign materials from being introduced therebetween or prevent the exterior from being damaged when the first spiral inclined surface 131*a* and the second spiral inclined surface 131*b* are directly exposed to the outside.

The forearm fitness equipment 100 according to one embodiment of the present invention includes a connecting rod 160 connecting the first handlebar 110 and the second handlebar 120 so that the first handlebar 110 and the second handlebar 120 are relatively movable in the longitudinal direction. The connecting rod 160 is installed to be inserted through a rod insertion hole 180 formed to pass through the forearm fitness equipment 100 along the central axis in the longitudinal direction.

The rod insertion hole 180 extends to pass through the first handlebar 110 and the second handlebar 120 along the central axis in the longitudinal direction of the forearm fitness equipment. A part of the rod insertion hole 180 formed in the first handlebar 110 is referred to as a first rod insertion hole 181, and a part of the rod insertion hole 180 formed in the second handlebar 120 is referred to as a second rod insertion hole 182.

The connecting rod 160 is installed to be inserted through the rod insertion hole 180. In the connecting rod 160, a head part 161 which is inserted through the first rod insertion hole 181 and which constitutes one end of the connecting rod 160 is fixed to an end groove 183 of the first rod insertion hole 181. In this case, for example, since the head part 161 of the connecting rod 160 is formed as a hexangular head, and the end groove 183 of the first rod insertion hole 181 is formed as a hexangular groove, the head part 161 and the end groove 183 may be fixed to each other.

The connecting rod 160 passes through the second rod insertion hole 182 and extends outward from second rod insertion hole 182, and the other end side of the connecting rod 160 is coupled to a fixing lever 170. The spring 190 is disposed between an end portion of the second rod insertion hole 182 and the fixing lever 170. More specifically, the connecting rod 160 passes through the second rod insertion hole 182 and extends into the hollow 125 of the second handlebar 120, and the spring 190 is installed in the hollow 125 between an inner end portion of the hollow 125 constituting the end portion of the second rod insertion hole 182 and the fixing lever 170. The fixing lever 170 may be coupled to an end portion of the connecting rod 160 to be movably inserted through an open end portion of the hollow 125 of the second handlebar 120. When the second handlebar 120 includes the hollow 125, and the spring 190 is disposed in the hollow 125, the spring 190 is prevented from being exposed to the outside.

According to the present invention, the fixing lever 170 is coupled to the connecting rod 160 so that a position thereof is adjustable. The connecting rod 160 includes a coupling part 164 on which a thread is formed on an outer circumferential surface of a portion coupled to the fixing lever 170, a thread is formed on an inner circumferential surface of the fixing lever 170, and the fixing lever 170 is fixed to the coupling part 164 in a screw-coupling manner. As described above, the position of the fixing lever 170 is adjustable according to a degree of coupling of the fixing lever 170 to the coupling part 164. Since the fixing lever 170 is formed so that the position thereof is adjustable at the end portion of the connecting rod 160, a magnitude of an elastic force of the spring 190 operated during the twisting exercise is adjustable. This will be described below.

The forearm fitness equipment 100 according to one embodiment of the present invention includes the spring 190 installed to provide an elastic force in the directions in which the first handlebar 110 and the second handlebar 120 approach each other.

The spring 190 is installed to be compressible by the connecting rod 160 according to relative rotation between the first handlebar 110 and the second handlebar 120. The connecting rod 160 is inserted and extends into the spring 190. One end of the spring 190 is supported by the second handlebar 120, and the other end thereof is supported by the fixing lever 170. Specifically, the spring 190 is disposed in the hollow 125 of the second handlebar 120, the one end thereof is supported by the inner end portion of the hollow 125, and the other end thereof is supported by the fixing lever 170.

A bearing 127 in contact with one end of the spring 190 may be formed in the inner end portion of the hollow 125. The bearing 127 may be a thrust bearing. When the second handlebar 120 rotates with respect to the first handlebar 110, the bearing 127 may the spring 190 to which a rotational force applied to prevent the inner end portion of the hollow 125 of the second handlebar 120 from being damaged by one end of the spring 190 and prevent noise from being generated.

While the first handlebar 110 and the second handlebar 120 are relatively rotated in the opposite directions along the first spiral inclined surface 131*a* and the second spiral inclined surface 131*b*, and when the second handlebar 120 is moved in the direction away from the first handlebar 110, a gap between the inner end portion of the hollow 125 and the fixing lever 170 decreases to compress the spring 190. Accordingly, the spring 190 is compressed and provides as much elastic force as the gap by which the second handlebar 120 is spaced apart from the first handlebar 110, and muscle training may be performed by relatively rotating the first handlebar 110 and the second handlebar 120 while overcoming the elastic force.

Since the fixing lever 170 is formed so that the position thereof is adjustable at the end portion of the connecting rod 160, a magnitude of the elastic force provided by the spring 190 is adjustable. Since the elastic force of the spring 190 is adjustable, a twisting strength between the first handlebar 110 and the second handlebar 120 is adjustable.

According to the present invention, the fixing lever 170 includes a first fixing lever 172 which is screw-coupled to the connecting rod 160 and has an accommodation space having a sleeve shape therein and a second fixing lever 174 which is inserted into the accommodation space of the first fixing lever and screw-coupled to the connecting rod 160. Since the fixing lever 170 is formed as a combination of the first fixing lever 172 and the second fixing lever 174, the fixing lever 170 is prevented from being released from the connecting rod 160. That is, since the second fixing lever 174 is inserted into and coupled to the first fixing lever 172 in a state in which the second fixing lever 174 is pressed against a bottom surface in the accommodation space, rotation of the first fixing lever 172 is restricted. Accordingly, even when a pressure is applied to the fixing lever 170 by the spring 190, the fixing lever 170 may maintain a fixed state at an adjusted position on the coupling part 164 of the connecting rod 160 without being released.

Meanwhile, a lid 116 may be installed in the hollow 115 of the first handlebar 110.

FIG. 6 is a view which is for describing an operation state of the forearm fitness equipment according to one embodiment of the present invention and which illustrates a state in which the cover parts are removed therefrom.

Referring to FIGS. 1 to 6, first, in the forearm fitness equipment, in order to adjust a twisting strength to match a user's own muscle strength, the user rotates the first fixing lever 172 and the second fixing lever 174 of the fixing lever 170. When the fixing lever 170 is rotated, since the spring 190 accommodated in the hollow 125 of the second handlebar 120 is compressed or restored, an elastic force is adjustable, and thus a twisting strength applied when an exercise is performed is adjustable to be strong or weak.

After the user adjusts the twisting strength to match the user's own strength, the user may grip the first handlebar 110 and the second handlebar 120 using both hands to relatively rotate the first handlebar 110 and the second handlebar 120 in the opposite directions. For example, the user may grip the first handlebar 110 and rotate the second handlebar 120 in one direction. Accordingly, the first spiral inclined surface 131*a* and the second spiral inclined surface 131*b* are relatively rotated along rotational paths of the spiral inclined surfaces. As seen from FIG. 5, the second spiral inclined surface 131*b* and the first spiral inclined surface 131*a* are relatively rotated with respect to each other in the opposite directions, the step 132*a* of the first spiral inclined surface 131*a* and the step 132*b* of the second spiral inclined surface 131*b* are spaced apart from each other, and the first handlebar 110 and the second handlebar 120 are moved in the directions away from each other.

In this case, the spring 190 elastically supported by the fixing lever 170 in the hollow 125 of the second handlebar 120 is compressed to provide an elastic force. Relative movement between the first handlebar 110 and the second handlebar 120 in the longitudinal direction is guided by the connecting rod 160, and relative rotation therebetween is guided by the first spiral inclined surface 131*a* and the second spiral inclined surface 131*b*. Since twist resistance is generated between the first handlebar 110 and the second handlebar 120 due to the elastic force of the spring 190, a forearm training exercise may be performed.

Then, when a force of rotating the second handlebar 120 is removed and the second handlebar 120 is released, due to an elastic restoring force of the spring 190, the second handlebar 120 is rotated in the direction to approach the first handlebar 110, the first spiral inclined surface 131*a* and the second spiral inclined surface 131*b* are returned to the exercise start position at which the steps 132*a* and 132*b* are in contact with each other, and thus one exercise using the forearm fitness equipment may be ended.

Hereinafter, forearm fitness equipment according to a modified embodiment of the present invention will be described. When the forearm fitness equipment according to the modified embodiment of the present invention is described, the same symbols will be assigned to the same components and components having the same functions according to one embodiment of the present invention, and the components are schematically described in order to avoid the repeated descriptions.

FIG. 7 is an exploded cross-sectional view for describing the forearm fitness equipment according to the modified embodiment of the present invention, and FIG. 8 is a cross-sectional view for describing the assembly of the forearm fitness equipment according to the modified embodiment of the present invention. FIGS. 9 and 10 are partially exploded perspective views illustrating a twist guide part and a spiral inclined surface of the forearm fitness equipment according to the modified embodiment of the present invention.

According to the forearm fitness equipment according to the modified embodiment of the present invention, there is a difference in that a twist guide part 130 arranged in a first handlebar 110 to face a second handlebar 120 is formed to be separated from the first handlebar 110, and an end surface of the first handlebar 110 and an end surface of the twist guide part 130, which face each other, include additional spiral inclined surfaces, and the remaining components are the same as or similar to the components illustrated in FIGS. 1 to 6.

A connecting rod 160 extends along a rod insertion hole 180 through the first handlebar 110, the twist guide part 130, and the second handlebar 120, and a fixing lever 170 is coupled to the connecting rod 160 through an opening of a hollow 125 of the second handlebar 120. A spring 190 is installed inside the hollow 125 of the second handlebar 120. Since the connecting rod 160 extends in a state in which the connecting rod 160 is inserted inside the spring 190, the spring 190 is disposed between a bearing 127 and the fixing lever 170. Accordingly, when the second handlebar 120 is moved away from the first handlebar 110, the spring 190 is compressed to provide an elastic force.

According to the forearm fitness equipment 100 according to the modified embodiment of the present invention, the twist guide part 130 is formed to be separated from the first handlebar 110, and the first handlebar 110, the twist guide part 130, and the second handlebar 120 are arranged to be in contact with each other and be separated from each other in a longitudinal direction.

Like the embodiment illustrated in FIGS. 1 to 6, a first spiral inclined surface 131*a* is formed on an end surface of one side of the twist guide part 130, and a second spiral inclined surface 131*b*, which complementarily corresponds to the first spiral inclined surface 131*a*, is formed on an end surface of the second handlebar 120. The first spiral inclined surface 131*a* and the second spiral inclined surface 131*b* are formed as a pair of spiral inclined surfaces in contact with each other to guide opposite rotational directions.

According to the modified embodiment, a third spiral inclined surface 131*c* is formed on an end surface of the other side of the twist guide part 130, and a fourth spiral inclined surface 131*d*, which complementarily corresponds to the third spiral inclined surface 131*c*, is formed on an end surface, which faces the twist guide part 130, of the first handlebar 110. The third spiral inclined surface 131*c* and the fourth spiral inclined surface 131*d* are spirally formed so that the third spiral inclined surface 131*c* and the fourth spiral inclined surface 131*d* are guided to be rotated in the opposite directions in a state in which the third spiral inclined surface 131*c* and the fourth spiral inclined surface 131*d* are in contact with each other. The third spiral inclined surface 131*c* and the fourth spiral inclined surface 131*d* are formed as another pair of spiral inclined surfaces in contact with each other to guide the opposite rotational directions.

Referring to FIG. 9, using an arc arrow, spiral rotational paths of the inclined surfaces are illustrated about a central axis in a longitudinal direction from uppermost ends to lowermost ends of the spiral inclined surfaces 131*a*, 131*b*, 131*c*, and 131*d*. As illustrated in FIG. 9, according to the modified embodiment of the present invention, the first spiral inclined surface 131*a* and the third spiral inclined surface 131*c* formed on both end surfaces of the twist guide part 130 spirally extend from the uppermost ends to the lowermost ends in a first rotational direction R1 about the central axis in the longitudinal direction. In addition, the fourth spiral inclined surface 131*d* of the first handlebar 110, which is arranged with the third spiral inclined surface 131*c* of the twist guide part 130, spirally extends from the uppermost end toward the lowermost end in a second rotational direction R2.

Steps 132*c* and 132*d*, which connect the uppermost ends and the lowermost ends, are formed at the third spiral inclined surface 131*c* of the twist guide part 130 and the fourth spiral inclined surface 131*d* of the first handlebar 110, and a position, at which the steps 132*c* and 132*d* are in contact with each other, is an exercise start position. A guide groove 136*a* is formed in the fourth spiral inclined surface

131*d*, and a guide protrusion 136*b* is formed on the third spiral inclined surface 131*c* to correspond to the guide groove 136*a*.

According to the modified embodiment of the present invention, guide grooves 136*a* are formed in the fourth spiral inclined surface 131*d* and the second spiral inclined surface 131*b* constituting end surfaces of the first and second handlebars 110 and 120, and guide protrusions 136*b* are formed on the third spiral inclined surface 131*c* and the first spiral inclined surface 131*a* formed to correspond to the guide protrusions 136*b* at both sides of the twist guide part 130.

In addition, the twist guide part 130 is manufactured in a process in which two separate parts are injection-molded and combined. Accordingly, the insertion manufacturing of the twist guide part 130 may be easy.

Relative movement between the third spiral inclined surface 131*c* and the fourth spiral inclined surface 131*d* is performed like relative rotation between the first spiral inclined surface 131*a* and the second spiral inclined surface 131*b*. That is, the position, at which the steps 132*c* and 132*d* of the third spiral inclined surface 131*c* and the fourth spiral inclined surface 131*d* are in contact with each other, is the exercise start position, and a position, at which the guide protrusion 136*b* comes into contact with an end of the guide groove 136*a* while the guide protrusion 136*b* is moved along the guide groove 136*a* when the third spiral inclined surface 131*c* and the fourth spiral inclined surface 131*d* are moved away from each other, is an exercise end position.

According to the modified embodiment of the present invention, since the twist guide part 130 is formed to be separated from and arranged with the first handlebar 110, the first handlebar 110 and the second handlebar 120 may be rotatably twisted in both directions.

An operation will be described with reference to FIGS. 7 to 10. For example, when the first handlebar 110 is gripped, and the second handlebar 120 is rotated in one direction, since the third spiral inclined surface 131*c* and the fourth spiral inclined surface 131*d* are rotated in a direction in which the steps 132*c* and 132*d* come into contact with each other, the third spiral inclined surface 131*c* and the fourth spiral inclined surface 131*d* are not rotated relatively. Accordingly, a state, in which the first handlebar 110 and the twist guide part 130 in contact with each other, is maintained, and the first spiral inclined surface 131*a* and the second spiral inclined surface 131*b* are rotated in a direction to be moved away from each other. Accordingly, in the state in which the first handlebar 110 and the twist guide part 130 are coupled, the second handlebar 120 is rotated in the direction to be spaced apart from the first handlebar 110.

When the first handlebar 110 is gripped, and the second handlebar 120 is rotated in the other direction, since the first spiral inclined surface 131*a* and the second spiral inclined surface 131*b* are rotated in a direction in which the steps 132*a* and 132*b* come into contact with each other, the first spiral inclined surface 131*a* and the second spiral inclined surface 131*b* are not rotated relatively. Accordingly, a state, in which the second handlebar 120 and the twist guide part 130 are in contact with each other, is maintained, and the third spiral inclined surface 131*c* and the fourth spiral inclined surface 131*d* are rotated in a direction to be moved away from each other. Accordingly, the second handlebar 120 and the twist guide part 130 are rotated together in a direction to be moved away from the first handlebar 110.

According to the relative rotational directions of the first handlebar 110 and the second handlebar 120, the first handlebar 110 and the second handlebar 120 are rotatable in both directions while the twist guide part 130 operates with the first handlebar 110 or the second handlebar 120.

According to the modified embodiment of the present invention, cover parts 150, which cover the spiral inclined surfaces, are provided on the first handlebar 110 and the second handlebar 120. The cover parts 150 according to the modified embodiment of the present invention include one cover part 156 extending from the first handlebar 110 to be spaced apart from the fourth spiral inclined surface 131*d* in a radial direction and to cover an outer circumferential side of the fourth spiral inclined surface 131*d*, the other cover part 157 extending from the second handlebar 120 to be spaced apart from the second spiral inclined surface 131*b* in the radial direction and to cover an outer circumferential side of the second spiral inclined surface 131*b*, and an intermediate cover part 158 provided between the one cover part 156 and the other cover part 157 and having a cylindrical shape. The intermediate cover part 158 includes a coupling protrusion 158*a*, and the coupling protrusion 158*a* is coupled to a coupling groove 158*d* formed in the twist guide part 130.

Accordingly, the intermediate cover part 158 prevents the spiral inclined surfaces 131*a*, 131*b*, 131*c*, and 131*d* from being exposed to the outside while moving in a space between the one cover part 156 and the other cover part 157 and the second and fourth spiral inclined surfaces 131*b* and 131*d* so that a degree of overlap between the one cover part 156 and the other cover part 157 is changed in the radial direction in conjunction with movement of the twist guide part 130.

According to forearm fitness equipment with the above-described configuration according to the present invention, a forearm can be trained through an exercise of twisting a handlebar which can be gripped by both hands.

The forearm fitness equipment according to the present invention has a simple configuration with a substantially bar shape and excellent portability. In addition, intensity of an exercise provided by the forearm fitness equipment can be easily adjusted.

The above description of the present invention is only exemplary, and it will be understood by those skilled in the art that the present invention may be easily changed to other concrete forms without changing the technological scope and essential features. Therefore, the above-described embodiments should be considered as only examples in all aspects and not for purposes of limitation. It should be interpreted that the scope of the present invention is defined by the appended claims and encompasses all modifications or alterations derived from meanings, the scope, and equivalents of the appended claims.

What is claimed is:

1. Forearm fitness equipment having a first handlebar and a second handlebar arranged in a longitudinal direction, the first handlebar including a twist guide part formed on a side surface, which faces the second handlebar, of the first handlebar, the forearm fitness equipment comprising:

a first spiral inclined surface formed on an end surface of one side of the twist guide part and formed as an inclined surface spirally extending from an uppermost end to a lowermost end in a first rotational direction about a central axis in the longitudinal direction;

a second spiral inclined surface formed on an end surface, which faces the twist guide part, of the second handlebar, formed as an inclined surface spirally extending from an uppermost end to a lowermost end in a second rotational direction opposite to the first rotational direction about the central axis in the longitudinal direction, and formed to be in contact with the first spiral inclined surface; and a spring installed to provide an elastic force in a direction in which the first spiral inclined surface and the second spiral inclined surface come into contact with each other.

2. The forearm fitness equipment of claim 1, wherein:

the first spiral inclined surface and the second spiral inclined surface include steps formed between the uppermost ends and the lowermost ends in spiral directions; and the first spiral inclined surface and the second spiral inclined surface are relatively rotated in opposite directions at an exercise start position which is a position at which the steps are in contact with each other.

3. The forearm fitness equipment of claim 1, wherein:

a guide groove is formed in one spiral inclined surface of the first spiral inclined surface and the second spiral inclined surface along a rotational path;

a guide protrusion, which is movably inserted into the guide groove, is formed on the remaining one spiral inclined surface of the first spiral inclined surface and the second spiral inclined surface; and when separation rotation is performed, the guide protrusion is hooked on an end portion of the guide groove to restrict the separation rotation between the first spiral inclined surface and the second spiral inclined surface.

4. The forearm fitness equipment of claim 1, wherein the twist guide part includes:

a third spiral inclined surface formed to be separated from the first handlebar, formed on an end surface of the other side of the twist guide part, and formed as an inclined surface spirally extending from an uppermost end to a lowermost end in the first rotational direction about the central axis in the longitudinal direction; and a fourth spiral inclined surface formed on an end surface, which faces the twist guide part, of the first handlebar, formed as an inclined surface spirally extending from an uppermost end to a lowermost end in the second rotational direction about the central axis in the longitudinal direction, and formed to be in contact with the third spiral inclined surface.

5. The forearm fitness equipment of claim 4, wherein:

the spiral inclined surfaces each include steps formed between the uppermost end and the lowermost end in a spiral direction; and the spiral inclined surfaces in contact with each other are relatively rotated in opposite directions at an exercise start position which is a position at which the steps are in contact with each other.

6. The forearm fitness equipment of claim 4, wherein:

a guide groove is formed in one spiral inclined surface of the spiral inclined surfaces in contact with each other along a rotational path;

a guide protrusion, which is movably inserted into the guide groove, is formed on the remaining one spiral inclined surface of the spiral inclined surfaces in contact with each other; and when separation rotation is performed, the guide protrusion is hooked on an end portion of the guide groove to restrict the separation rotation between the spiral inclined surfaces in contact with each other.

7. The forearm fitness equipment of claim 4, comprising:

a connecting rod inserted through a rod insertion hole formed along the central axis in the longitudinal direction of the forearm fitness equipment and extending to the second handlebar in a state in which one end of the connecting rod is fixed to the first handlebar; and a fixing lever fixed to the other end of the connecting rod, wherein one end of the spring is fixed to the second handlebar, and the other end of the spring is fixedly installed on the fixing lever.

8. The forearm fitness equipment of claim 7, wherein:

a hollow is formed in the second handlebar;

the spring is disposed in the hollow; and a bearing is installed on an inner end portion, which is in contact with the one end of the spring, of the hollow.

9. The forearm fitness equipment of claim 7, wherein:

the fixing lever is formed so that a position of the fixing lever is adjustable along the other end of the connecting rod; and a twisting strength provided when an exercise is performed is adjustable by changing a degree of compression of the spring to adjust a position of the fixing lever.

10. The forearm fitness equipment of claim 9, wherein:

the fixing lever is coupled to a coupling part formed on the connecting rod in a screw-coupling manner; and the fixing lever includes a first fixing lever screw-coupled to the connecting rod and including an accommodation space having a sleeve shape and a second fixing lever inserted into the accommodation space of the first fixing lever and screw-coupled to the connecting rod.

11. The forearm fitness equipment of claim 1, comprising:

a connecting rod inserted through a rod insertion hole formed along the central axis in the longitudinal direction of the forearm fitness equipment and extending to the second handlebar in a state in which one end of the connecting rod is fixed to the first handlebar; and a fixing lever fixed to the other end of the connecting rod, wherein one end of the spring is fixed to the second handlebar, and the other end of the spring is fixedly installed on the fixing lever.

12. The forearm fitness equipment of claim 11, wherein:

a hollow is formed in the second handlebar;

the spring is disposed in the hollow; and a bearing is installed on an inner end portion, which is in contact with the one end of the spring, of the hollow.

13. The forearm fitness equipment of claim 11, wherein:

the fixing lever is formed so that a position of the fixing lever is adjustable along the other end of the connecting rod; and a twisting strength provided when an exercise is performed is adjustable by changing a degree of compression of the spring to adjust a position of the fixing lever.

14. The forearm fitness equipment of claim 13, wherein:

the fixing lever is coupled to a coupling part formed on the connecting rod in a screw-coupling manner; and the fixing lever includes a first fixing lever screw-coupled to the connecting rod and including an accommodation space having a sleeve shape and a second fixing lever inserted into the accommodation space of the first fixing lever and screw-coupled to the connecting rod.

* * * * *